US011719065B2

(12) United States Patent
Books et al.

(10) Patent No.: US 11,719,065 B2
(45) Date of Patent: Aug. 8, 2023

(54) CONFIGURABLE COUPLING ASSEMBLY

(71) Applicant: OneSubsea IP UK Limited, London (GB)

(72) Inventors: Jacob Books, Houston, TX (US); Phillip Theriot, Houston, TX (US); Matthew Hays, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 17/097,677

(22) Filed: Nov. 13, 2020

(65) Prior Publication Data

US 2022/0154545 A1 May 19, 2022

(51) Int. Cl.
*E21B 33/04* (2006.01)
*E21B 33/038* (2006.01)
*E21B 33/043* (2006.01)

(52) U.S. Cl.
CPC ..... *E21B 33/0415* (2013.01); *E21B 33/038* (2013.01); *E21B 33/043* (2013.01)

(58) Field of Classification Search
CPC ... E21B 33/0415; E21B 33/038; E21B 33/043
See application file for complete search history.

(56) References Cited

U.S. PATENT DOCUMENTS 3,207,221 A * 9/1965 Cochran ..... E21B 33/06 166/85.4
4,651,831 A * 3/1987 Baugh ..... E21B 33/047 166/344
5,051,103 A * 9/1991 Neuroth ..... E21B 33/0385 439/192
5,417,459 A 5/1995 Gray et al.
5,996,697 A * 12/1999 Vick ..... E21B 23/04 166/115
6,082,460 A * 7/2000 June ..... E21B 33/04 166/348
6,227,300 B1 * 5/2001 Cunningham ..... E21B 33/035 166/339
6,227,301 B1 * 5/2001 Edwards ..... E21B 34/04 166/344
6,494,266 B2 * 12/2002 Bartlett ..... F16K 3/0218 166/339

(Continued)

FOREIGN PATENT DOCUMENTS

GB 2496974 A * 5/2013 ..... E21B 33/043
JP 2015028352 A 2/2015
WO WO-2019164474 A1 * 8/2019 ..... E21B 17/028

OTHER PUBLICATIONS

International Search Report and Written Opinion issued in International Patent Application No. PCT/US2021/058901 dated Feb. 25, 2022; 10 pages.

*Primary Examiner* — Aaron L Lembo
(74) *Attorney, Agent, or Firm* — Eileen Pape

(57) ABSTRACT

A configurable coupling assembly includes a body having a central bore and multiple receptacles. The central bore is configured to facilitate flow of fluid through the body, the receptacles are positioned radially outward from the central bore, the receptacles are substantially the same as one another, the receptacles are configured to receive respective couplers, and the respective couplers include multiple different types of couplers.

4 Claims, 5 Drawing Sheets

(56) References Cited

U.S. PATENT DOCUMENTS 6,612,368 B2 * 9/2003 Kent ..... F16K 3/02 166/75.13
6,659,181 B2 * 12/2003 Hartmann ..... E21B 33/035 166/344
7,025,132 B2 * 4/2006 Kent ..... F16K 31/1225 166/87.1
7,225,877 B2 * 6/2007 Yater ..... B63B 27/34 166/344
8,087,465 B2 * 1/2012 Huang ..... E21B 33/037 166/339
8,985,219 B2 * 3/2015 Cruden ..... E21B 43/013 166/340
9,291,021 B2 * 3/2016 Donald ..... E21B 33/038
9,631,460 B2 * 4/2017 June ..... E21B 33/043
10,199,751 B1 * 2/2019 Gelderd ..... E21B 33/043
10,309,190 B2 * 6/2019 June ..... E21B 33/043
10,415,329 B2 * 9/2019 Nonmacher ..... E21B 47/001
10,794,156 B2 * 10/2020 Lara ..... E21B 43/013
10,941,627 B2 * 3/2021 Oedegaard ..... E21B 17/05
2002/0000315 A1 * 1/2002 Kent ..... E21B 43/013 166/85.4
2003/0146000 A1 * 8/2003 Dezen ..... E21B 33/035 166/368
2004/0104024 A1 * 6/2004 Kent ..... E21B 34/04 166/85.4
2007/0144746 A1 * 6/2007 Jonas ..... E21B 17/08 166/380
2011/0095526 A1 * 4/2011 Vanderford ..... E21B 33/03 285/313
2011/0247798 A1 * 10/2011 June ..... E21B 33/043 166/67
2014/0112699 A1 4/2014 Lewkoski
2014/0332223 A1 * 11/2014 June ..... E21B 33/043 166/351
2016/0024878 A1 * 1/2016 June ..... E21B 33/047 166/373
2018/0179839 A1 6/2018 Nguyen
2019/0186215 A1 6/2019 Migutin
2021/0087899 A1 * 3/2021 DeBerry ..... E21B 33/04

* cited by examiner

CONFIGURABLE COUPLING ASSEMBLY

BACKGROUND

The present disclosure relates generally to a configurable coupling assembly.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Fluids (e.g., hydrocarbons) may be extracted from subsurface reservoirs and transported to the surface for commercial sales, such as for use in the power industry, transportation industry, manufacturing industry, and other applicable industries. For example, a well may be drilled into the ground to a subsurface reservoir, and equipment may be installed in the well and on the surface to facilitate extraction of the fluids. In some cases, the wells may be offshore (e.g., subsea), and the equipment may be disposed underwater, on offshore platforms, and/or on floating systems.

In some drilling and production systems, a hanger, such as a tubing hanger, may be used to suspend a string (e.g., piping for a flow in and/or out of the well). Such a hanger may be disposed within a spool of a wellhead, which supports both the hanger and the string. For example, a tubing hanger may be lowered into a tubing spool by a drilling string. During the running or lowering process, the tubing hanger may be coupled to the drilling string by a tubing hanger running tool (THRT). Once the tubing hanger has been lowered into a landed position within the tubing spool, the tubing hanger may be permanently locked into position. The THRT may then be uncoupled from the tubing hanger and extracted from the wellhead by the drilling string.

The tubing hanger may include a body having a central bore, and the tubing hanger may include multiple couplers positioned radially outward from the central bore. The THRT may also include a body having a central bore, and the THRT may include multiple couplers positioned radially outward from the central bore. The couplers of the tubing hanger are configured to engage the couplers of the THRT, thereby establishing fluid connection(s) and/or communication link(s) across the tubing hanger/THRT interface. For example, the tubing hanger and the THRT may include one or more electrical couplers configured to establish an electrical connection through the tubing hanger/THRT interface. In addition, the tubing hanger and the THRT may include one or more fiber optic couplers configured to establish an optical data connection through the tubing hanger/THRT interface. Furthermore, the tubing hanger and the THRT may include one or more hydraulic couplers configured to establish a hydraulic connection through the tubing hanger/THRT interface. The tubing hanger and the THRT may also include one or more chemical injection couplers configured to establish a chemical connection through the tubing hanger/THRT interface.

A tubing hanger may be particularly designed and manufactured to include couplers for a particular application. For example, multiple receptacles may be formed within the body of the tubing hanger, and each receptacle may be particularly configured to receive a respective coupler. By way of example, the receptacle for an electrical coupler and the receptacle for a hydraulic coupler may have different shapes, different lengths, different cross-sectional areas, different mounting features, or a combination thereof. Accordingly, the body of the tubing hanger may be particularly formed (e.g., machined) to accommodate the selected couplers. In addition, the THRT may be particularly designed and manufactured to include corresponding couplers to interface with the couplers of the tubing hanger. Unfortunately, the costs associated with particularly designing and manufacturing a tubing hanger and a THRT for each application may significantly increase the costs associated with extracting hydrocarbons from reservoirs.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain embodiments, a configurable coupling assembly includes a body having a central bore and multiple receptacles. The central bore is configured to facilitate flow of fluid through the body, the receptacles are positioned radially outward from the central bore, the receptacles are substantially the same as one another, the receptacles are configured to receive respective couplers, and the respective couplers include multiple different types of couplers.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
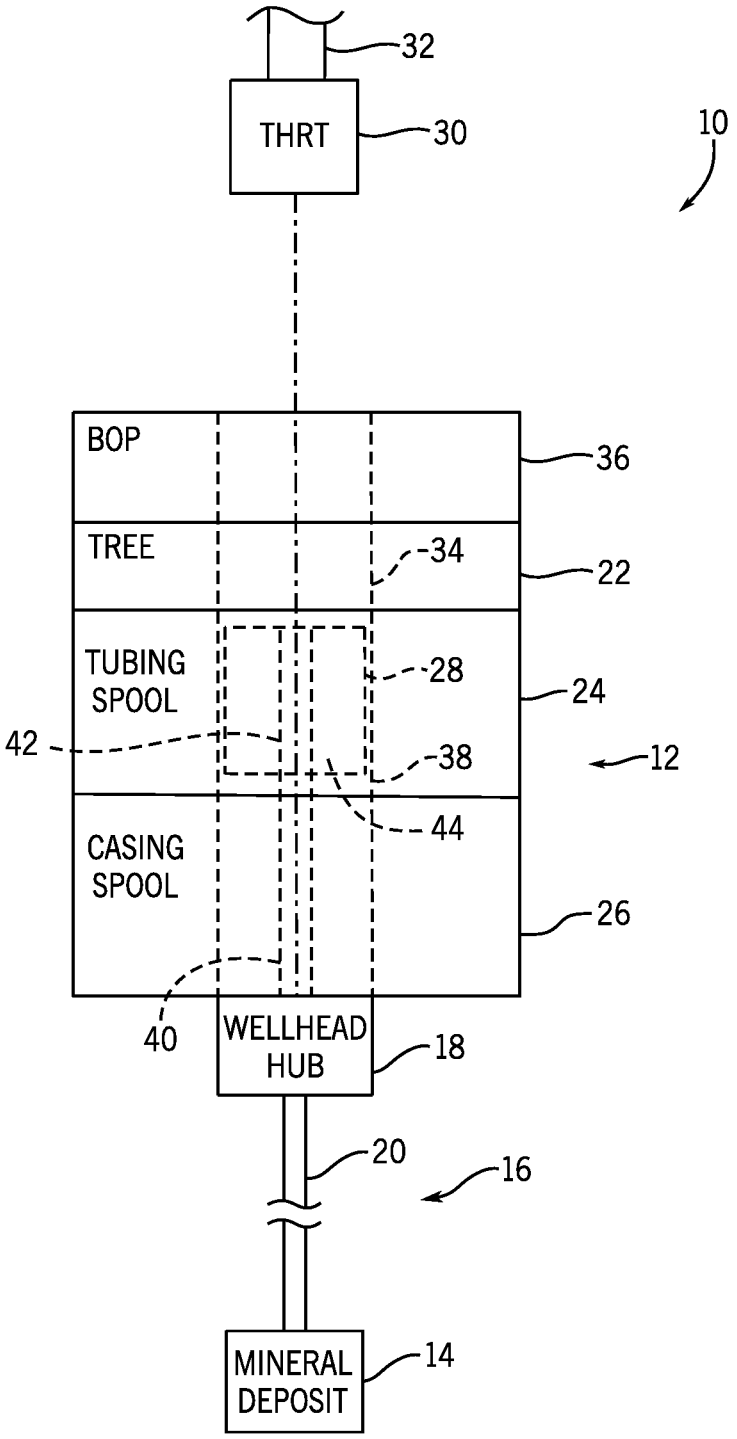
FIG. 1 is a block diagram of an embodiment of a resource extraction system.

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

As explained above, a tubing hanger may be particularly designed and manufactured to include couplers for a particular application. For example, a tubing hanger may include eleven hydraulic couplers and two electrical couplers. In addition, a tubing hanger running tool (THRT) may be particularly designed and manufactured to include corresponding couplers, thereby enabling the THRT to interface with the tubing hanger. Unfortunately, the costs associated with particularly designing and manufacturing tubing hangers and THRTs for each application may significantly increase the costs associated with extracting hydrocarbons from reservoirs.

In certain embodiments disclosed herein, a configurable coupling assembly (e.g., tubing hanger, THRT, etc.) includes a body having a central bore and multiple receptacles. The central bore is configured to facilitate flow of fluid (e.g., hydrocarbons) through the body. In addition, each receptacle is configured to receive a respective coupler, the receptacles are substantially the same as one another, and the receptacles are positioned radially outward from the central bore. Furthermore, in certain embodiments, the configurable coupling assembly includes multiple couplers, in which each coupler is disposed within a respective receptacle of the body. In addition, the couplers disposed within the receptacles of the body include at least two different types of couplers. For example, the different types of couplers may include two or more of an electrical coupler, a fiber optic coupler, a hydraulic coupler, or a chemical injection coupler. Because the receptacles are substantially the same as one another and configured to receive couplers of different types, a variety of coupling assembly configurations may be established with a single body (e.g., single type of body). For example, a tubing hanger and a compatible THRT may be formed by selecting appropriate types of couplers for an application, disposing the couplers in the respective receptacles of the tubing hanger and the THRT, and coupling the THRT to the tubing hanger. As a result, the process of particularly designing and manufacturing a tubing hanger and a THRT for a particular application (e.g., particularly forming the body of the tubing hanger and the body of the THRT to accept particular types of couplers) may be obviated, thereby substantially reducing the costs associated with extraction of hydrocarbons.

FIG. 1 is a block diagram of an embodiment of a resource extraction system 10. The resource extraction system 10 may be configured to extract various minerals and natural resources, including hydrocarbons (e.g., oil and/or natural gas) from the earth, or the resource extraction system may be configured to inject substances into the earth. In some embodiments, the resource extraction system 10 is land-based (e.g., a surface system) or subsea (e.g., a subsea system). As illustrated, the resource extraction system 10 includes a wellhead 12 coupled to a mineral deposit 14 via a well 16. The well 16 includes a wellhead hub 18 and a well-bore 20. The wellhead hub 18 may include a large diameter hub that is disposed at the termination of the well-bore 20. The wellhead hub 18 provides for the connection of the wellhead 12 to the well 16.

The wellhead 12 includes multiple components that control and regulate activities and conditions associated with the well 16. For example, the wellhead 12 may include bodies, valves, and seals that route produced minerals from the mineral deposit 14, provide for regulating pressure in the well 16, and provide for the injection of chemicals into the well-bore 20 (down-hole). In the illustrated embodiment, the wellhead 12 includes a production tree 22, a tubing spool 24, a casing spool 26, and a tubing hanger 28. The resource extraction system 10 may include other device(s) that are coupled to the wellhead 12 and/or device(s) that are used to assemble and/or control various components of the wellhead 12. For example, in the illustrated embodiment, the resource extraction system 10 includes a tubing hanger running tool (THRT) 30 suspended from a drill string 32. In certain embodiments, the tubing hanger 28 supports tubing (e.g., a tubing string). During a running or lowering process, the THRT 30 is coupled to the tubing hanger 28, thereby coupling the tubing hanger 28 to the drilling string 32. The THRT 30, which is coupled to the tubing hanger 28, is lowered (e.g., run) from an offshore vessel to the wellhead 12. Once the tubing hanger 28 has been lowered into a landed position within the tubing spool 24, the tubing hanger 28 may be permanently locked into position. The THRT 30 may then be uncoupled from the tubing hanger 28 and extracted from the wellhead 12 by the drilling string 32, as illustrated. While the tubing hanger 28 is landed in the tubing spool 24 in the illustrated embodiment, in other embodiments, the tubing spool may be omitted, and the tubing hanger may be landed in another suitable portion of the wellhead.

The production tree 22 may include a variety of flow paths (e.g., bores), valves, fittings, and controls for operating the well 16. For instance, the production tree 22 may include a frame that is disposed about a tree body, a flow-loop, actuators, and valves. Further, the production tree 22 may be in fluid communication with the well 16. As illustrated, the production tree 22 includes a tree bore 34. The tree bore 34 provides for completion and workover procedures, such as the insertion of tools (e.g., the tubing hanger 28) into the wellhead 12, the injection of various chemicals into the well 16 (down-hole), and the like. Further, minerals extracted from the well 16 (e.g., oil and/or natural gas) may be regulated and routed via the production tree 22. For instance, the production tree 22 may be coupled to a jumper or a flowline that is tied back to other components, such as a manifold. Accordingly, produced minerals flow from the well 16 to the manifold via the production tree 22 before being routed to shipping or storage facilities. A blowout preventer (BOP) 36 may also be included, either as a part of the tree production 22 or as a separate device. The BOP 36 may include a variety of valves, fittings, and controls to block oil, gas, or other fluid from exiting the well in the event of an unintentional release of pressure or an overpressure condition.

The tubing spool 24 provides a base for the production tree 22. The tubing spool 24 may be one of many components in a modular subsea resource extraction system 10 that is run from an offshore vessel. The tubing spool 24 includes a tubing spool bore 38, and the casing spool 26 includes a casing spool bore 40. The bores 38 and 40 connect (e.g., enable fluid communication between) the tree bore 34 and the well 16. Thus, the bores 38 and 40 may provide access to the well-bore 20 for various completion and workover procedures. For example, components may be run down to the wellhead 12 and disposed in the tubing spool bore 38 and/or the casing spool bore 40 to seal-off the well-bore 20, to inject chemicals down-hole, to suspend tools down-hole, to retrieve tools, and the like.

The well-bore 20 may contain elevated fluid pressures. For example, pressures within the well-bore 20 may exceed 10,000 pounds per square inch (PSI), 15,000 PSI, or 20,000 PSI. Accordingly, resource extraction systems 10 employ various mechanisms, such as mandrels, seals, plugs, and valves, to control and regulate the well 16. For example, the illustrated tubing hanger 28 may be disposed within the wellhead 12 to secure tubing suspended in the well-bore 20, and to provide a path for hydraulic control fluid, chemical injection, electrical connection(s), fiber optic connection(s), and the like. The tubing hanger 28 includes a central bore 42 that extends through the center of a body 44 of the tubing hanger 28, and that is in fluid communication with the casing spool bore 40 and the well-bore 20. The central bore 42 is configured to facilitate flow of hydrocarbons through the body 44 of the tubing hanger 28.

In certain embodiments, the body 44 of the tubing hanger 28 (e.g., configurable tubing hanger) also includes receptacles positioned radially outward from the central bore 42. Each receptacle is configured to receive a respective coupler, and the receptacles are substantially the same as one another. Furthermore, in certain embodiments, the tubing hanger 28 includes multiple couplers of at least two different types, and each coupler is disposed within a respective receptacle of the body 44 of the tubing hanger 28. For example, the different types of couplers may include two or more of an electrical coupler, a fiber optic coupler, a hydraulic coupler, or a chemical injection coupler. Because the receptacles are substantially the same as one another and configured to receive couplers of different types, a variety of tubing hanger configurations may be established with a single body (e.g., single type of body). For example, the tubing hanger 28 may be formed by selecting appropriate types of couplers for an application and disposing the couplers in the respective receptacles of the tubing hanger body. As a result, the process of particularly designing and manufacturing a tubing hanger for a particular application (e.g., particularly forming the body of the tubing hanger to accept particular types of couplers) may be obviated, thereby substantially reducing the costs associated with extraction of hydrocarbons.

As used herein with reference to the couplers, the type of coupler is based on a type of connection configured to be established by the coupler. For example, one type of coupler is an electrical coupler (e.g., electrical connector) configured to establish one or more electrical connections. Another type of coupler is a hydraulic coupler configured to establish a hydraulic connection. A further type of coupler is a chemical injection coupler configured to establish a chemical connection. In addition, another type of coupler is a fiber optic coupler configured to establish an optical connection.

Figure 2:
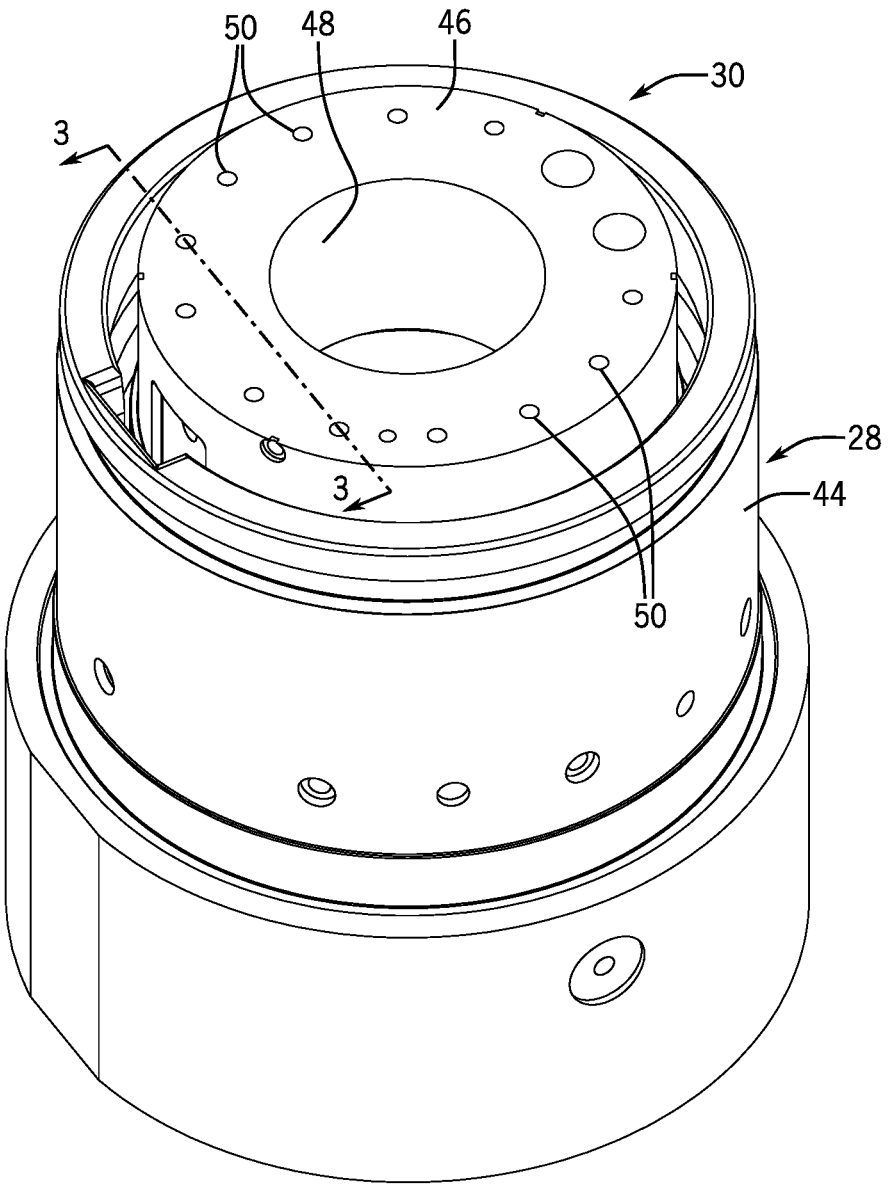
FIG. 2 is a perspective view of an embodiment of a tubing hanger and a tubing hanger running tool that may be employed within the resource extraction system of FIG. 1.

FIG. 2 is a perspective view of an embodiment of a tubing hanger 28 and a tubing hanger running tool (THRT) 30 that may be employed within the resource extraction system of FIG. 1. As illustrated, the THRT 30 is coupled to the tubing hanger 28. As previously discussed, during a running or lowering process, the THRT 30 is coupled to the tubing hanger 28, thereby coupling the tubing hanger 28 to the drilling string. The THRT 30, which is coupled to the tubing hanger 28, may be lowered (e.g., run) from an offshore vessel to the wellhead. Once the tubing hanger 28 has been lowered into a landed position within the tubing spool, the tubing hanger 28 may be permanently locked into position. The THRT 30 may then be uncoupled from the tubing hanger 28 and extracted from the wellhead by the drilling string. The tubing hanger 28 and the THRT 30 may be selectively coupled to one another by any suitable connection system, such as via one or more latches, via a protrusion/recess connection, via a threaded connection, via another suitable connection, or a combination thereof.

In certain embodiments, the body 44 of the tubing hanger 28 (e.g., configurable tubing hanger) includes receptacles positioned radially outward from the central bore. Each receptacle is configured to receive a respective coupler, and the receptacles are substantially the same as one another. Furthermore, in certain embodiments, the tubing hanger 28 includes multiple couplers, and each coupler is disposed within a respective receptacle of the body 44 of the tubing hanger 28. In addition, the couplers disposed within the receptacles of the body 44 include at least two different types of couplers. For example, the different types of couplers may include two or more of an electrical coupler, a fiber optic coupler, a hydraulic coupler, or a chemical injection coupler. Because the receptacles are substantially the same as one another and configured to receive couplers of different types, a variety of tubing hanger configurations may be established with a single body (e.g., single type of body). Furthermore, in certain embodiments, a body 46 of the THRT 30 (e.g., configurable THRT) includes receptacles positioned radially outward from a central bore 48, which may be configured to facilitate fluid flow through the body 46. Each receptacle is configured to receive a respective coupler, and the receptacles are substantially the same as one another. In certain embodiments, the THRT 30 includes multiple couplers, and each coupler is disposed within a respective receptacle of the body 46 of the THRT 30. In addition, the couplers disposed within the receptacles of the body 46 include at least two different types of couplers. For example, the different types of couplers may include two or more of an electrical coupler, a fiber optic coupler, a hydraulic coupler, or a chemical injection coupler. Because the receptacles are substantially the same as one another and configured to receive couplers of different types, a variety of THRT configurations may be established with a single body (e.g., single type of body). In the illustrated embodiment, the body 46 of the THRT 30 has multiple passages 50, and each passage extends to a respective receptacle. Each passage 50 is configured to facilitate passage of a conduit (e.g., electrical conduit, fiber optic conduit, etc.) or a fluid (e.g., hydraulic fluid, a liquid chemical, etc.) to a coupler within the respective receptacle.

Because each receptacle of the tubing hanger 28 is configured to receive any compatible type of coupler (e.g., electrical coupler, fiber optic coupler, hydraulic coupler, chemical injection coupler, etc.), and each receptacle of the THRT 30 is configured to receive any compatible type of coupler (e.g., electrical coupler, fiber optic coupler, hydraulic coupler, chemical injection coupler, etc.), the tubing hanger 28 and the THRT 30 may be formed by selecting appropriate types of couplers for an application, disposing the couplers in the respective receptacles of the tubing hanger and the THRT, and coupling the THRT to the tubing hanger. As a result, the process of particularly designing and manufacturing a tubing hanger and a THRT for a particular application (e.g., particularly forming the body of the tubing hanger and the body of the THRT to accept particular types of couplers) may be obviated, thereby substantially reducing the costs associated with extraction of hydrocarbons. While the tubing hanger 28 and the THRT 30 each include receptacles that are substantially the same as one another and configured to receive couplers of different types in the illustrated embodiment, in other embodiments, only one of the tubing hanger or the THRT may have receptacles that are substantially the same as one another and configured to receive couplers of different types.

Furthermore, while a configurable tubing hanger and a configurable THRT are disclosed herein, in certain embodiments, another suitable configurable coupling assembly (e.g., a handling and test tool, a test stump, another suitable coupling assembly within a resource extraction system, etc.) may include the structures/elements disclosed herein, such as multiple receptacles disposed radially outward from a central bore, in which the receptacles are substantially the same as one another, the receptacles are configured to receive respective couplers, and the respective couplers include at least two different types of couplers. Furthermore, while the interface between the tubing hanger and the THRT is disclosed herein, in certain embodiments, at least one coupling assembly of another suitable interface (e.g., a THRT-drilling/landing string interface, a THRT-handling and test tool interface, a tubing hanger-handling and test tool interface, a THRT-test stump interface, another suitable interface within a resource extraction system, etc.) may include the structures/elements disclosed herein, such as multiple receptacles disposed radially outward from a central bore, in which the receptacles are substantially the same as one another, the receptacles are configured to receive respective couplers, and the respective couplers include at least two different types of couplers. For example, a portion of the THRT configured to interface with the drilling string may include multiple receptacles disposed radially outward from the central bore of the THRT, in which the receptacles are substantially the same as one another, the receptacles are configured to receive respective couplers, and the respective couplers include at least two different types of couplers.

Figure 3:
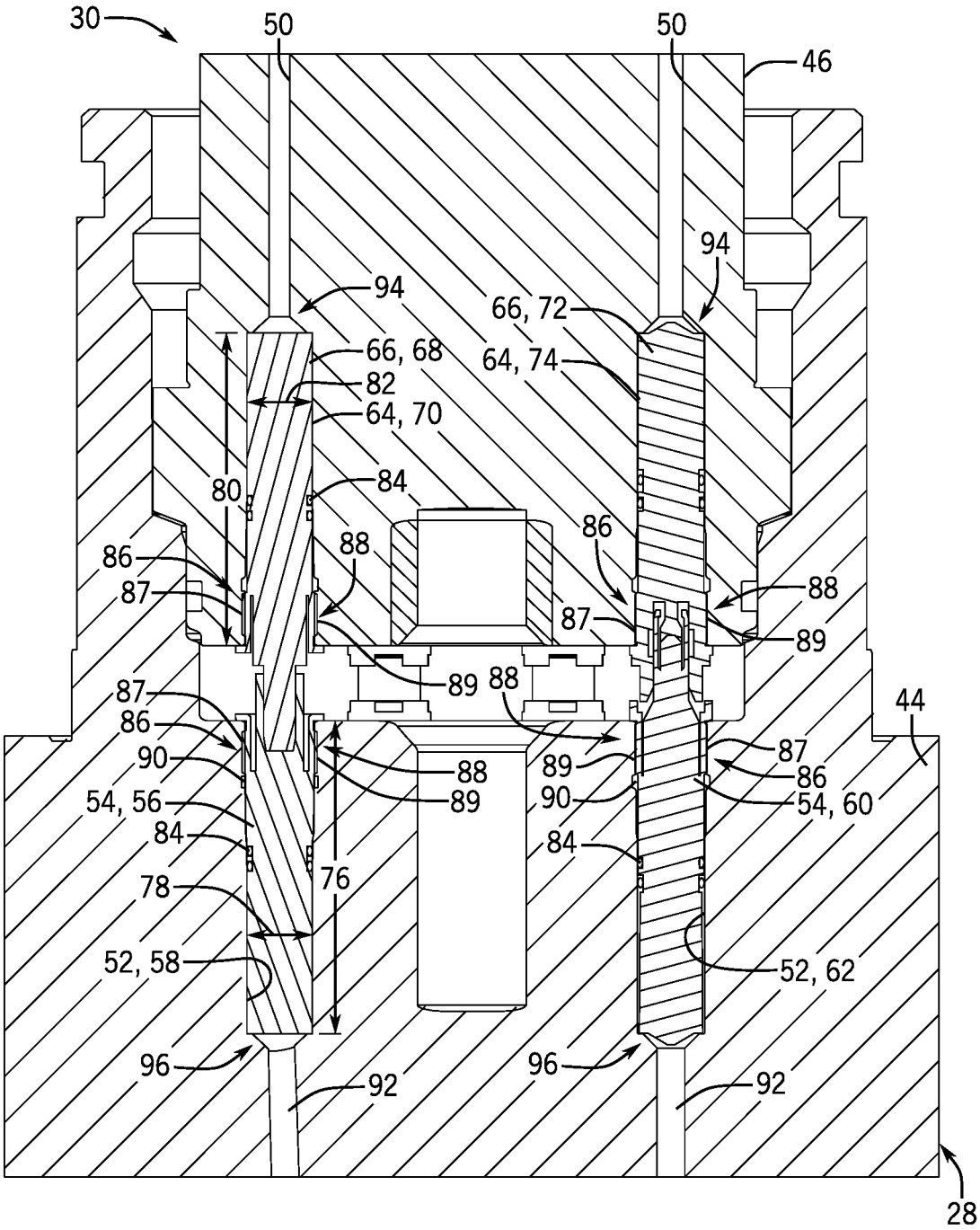
FIG. 3 is a cross-sectional view of the tubing hanger and the tubing hanger running tool of FIG. 2, taken along line 3-3 of FIG. 2.

FIG. 3 is a cross-sectional view of the tubing hanger 28 and the tubing hanger running tool 30 of FIG. 2, taken along line 3-3 of FIG. 2. As previously discussed, the body 44 of the tubing hanger 28 includes multiple receptacles 52, and the receptacles 52 are positioned radially outward from the central bore. In addition, the receptacles 52 are substantially the same as one another, the receptacles 52 of the tubing hanger body 44 are configured to receive respective couplers 54, and the respective couplers 54 include different types of couplers 54. In the illustrated embodiment, the couplers 54 include an electrical coupler 56 (e.g., electrical connector) disposed within a first receptacle 58 of the tubing hanger body 44. The couplers 54 also includes a hydraulic coupler 60 disposed within a second receptacle 62 of the tubing hanger body 44. Because the first and second receptacles are the same as one another, the hydraulic coupler 60 may be disposed within the first receptacle 58, and the electrical coupler 56 may be disposed within the second receptacle 62. Furthermore, each receptacle 52 may receive another compatible electrical coupler, another compatible hydraulic coupler, a compatible fiber optic coupler, a compatible chemical injection coupler, or another suitable type of compatible coupler.

In addition, the body 46 of the THRT 30 includes multiple receptacles 64, and the receptacles 64 are positioned radially outward from the central bore. In addition, the receptacles 64 are substantially the same as one another, the receptacles 64 of the THRT body 46 are configured to receive respective couplers 66, and the respective couplers 66 include different types of couplers 66. In the illustrated embodiment, the couplers 66 include an electrical coupler 68 (e.g., electrical connector) disposed within a first receptacle 70 of the THRT body 46. The couplers 66 also include a hydraulic coupler 72 disposed within a second receptacle 74 of the THRT body 46. Because the first and second receptacles are the same as one another, the hydraulic coupler 72 may be disposed within the first receptacle 70, and the electrical coupler 68 may be disposed within the second receptacle 74. Furthermore, each receptacle 64 may receive another compatible electrical coupler, another compatible hydraulic coupler, a compatible fiber optic coupler, a compatible chemical injection coupler, or another suitable type of compatible coupler.

In certain embodiments, the receptacles 52 of the tubing hanger 28 are substantially the same as the receptacles 64 of the THRT 30. However, in other embodiments, the receptacles 52 of the tubing hanger 28 are different than the receptacles 64 of the THRT 30. As used herein with respect to the receptacles, "substantially the same" refers to receptacles that have substantially the same shape, substantially the same dimensions, and substantially the same mounting feature(s). Furthermore, with regard to the shape, dimensions, and mounting feature(s), "substantially the same" refers to shapes/dimensions/mounting features being within manufacturing tolerances of one another. In addition, the dimensions and shape of the receptacles may be configured to accommodate the largest expected coupler. For example, a length 76 of each receptacle 52 of the tubing hanger 28 may be selected to accommodate the longest expected coupler 54, and a cross-section 78 of each receptacle 52 of the tubing hanger 28 may be selected to accommodate the coupler 54 having the largest expected cross-section (e.g., diameter, etc.). Furthermore, a length 80 of each receptacle 64 of the THRT 30 may be selected to accommodate the longest expected coupler 66, and a cross-section 82 of each receptacle 64 of the THRT 30 may be selected to accommodate the coupler 66 having the largest expected cross-section (e.g., diameter, etc.).

In the illustrated embodiment, the outer cross-section of each coupler is substantially the same as the inner cross-section of each receptacle. As a result, fluid flow around the coupler may be substantially blocked. In certain embodiments, a coupler may have a smaller cross-section (e.g., outer diameter) than the cross-section (e.g., inner diameter) of the respective recess. In such embodiments, an adapter may be disposed between the coupler and the respective recess to substantially block the fluid flow around the coupler. In addition, one or more seals 84 (e.g., o-ring(s), etc.) may be positioned between the coupler and the surrounding body, thereby further reducing or substantially eliminating the flow of fluid around the coupler. For example, recess(es) may be formed in the coupler and/or in the respective receptacle to receive respective seal(s).

In the illustrated embodiment, each receptacle 52 of the tubing hanger 28 includes mounting feature(s) 86 configured to couple the respective coupler 54 to the body 44, and each receptacle 64 of the THRT 30 includes mounting feature(s) 86 configured to couple the respective coupler 66 to the body 46. The mounting features 86 of the receptacles may be configured to engage corresponding mounting features 88 of the respective couplers to couple the couplers to the respective body. In the illustrated embodiment, the mounting feature(s) 86 of each receptacle include threads 87 configured to engage corresponding threads 89 of the corresponding mounting feature(s) 88 of the respective coupler, thereby coupling the coupler to the respective body. In certain embodiments, an undercut 90 may be formed adjacent to the threads 87 of each receptacle to reduce stress on the receptacle's threads. Furthermore, in certain embodiments, a first keyway may be formed across the threads of each receptacle (e.g., along a longitudinal axis of the receptacle), and a second keyway may be formed across the corresponding threads of the respective coupler (e.g., along a longitudinal axis of the respective coupler). A key may be disposed within the keyways to block rotation of the coupler relative to the body. For example, the threads of the coupler may be engaged with the threads of the receptacle, the coupler may then be rotated until the second keyway of the coupler is aligned with the first keyway of the receptacle. The key may be inserted into the keyways to block rotation of the coupler, thereby substantially maintaining the coupler at a target orientation (e.g., about the longitudinal axis of the coupler/receptacle) within the receptacle and substantially reducing the possibility of disengagement of the threaded connection due to rotation of the coupler. For couplers that do not include a keyway formed across the threads, the coupler may be coupled to the body via engagement of the threads of the coupler with the threads of the respective receptacle.

While threaded connections that include keyways are disclosed above, in certain embodiments, the threaded connections of the tubing hanger receptacles and/or the THRT receptacles may not include keyways. Furthermore, while mounting feature(s) that include threads are disclosed above, in certain embodiments, the receptacles of the tubing hanger and/or the receptacles of the THRT may have other suitable mounting features (e.g., alone or in combination with the threads). For example, in certain embodiments, the mounting feature(s) of each receptacle of the tubing hanger and/or the mounting feature(s) of each receptacle of the THRT may include a latch configured to engage the respective coupler (e.g., a respective protrusion of the corresponding mounting feature of the respective coupler), a protrusion configured to engage a recess of the corresponding mounting feature of the respective coupler, a recess configured to engage a protrusion of the corresponding mounting feature of the respective coupler, a magnet configured to engage a ferromagnetic element of the corresponding mounting feature of the respective coupler, a ferromagnetic element configured to engage a magnet of the corresponding mounting feature of the respective coupler, other suitable coupling device(s), or a combination thereof. Furthermore, in certain embodiments, each receptacle of the tubing hanger and/or THRT may include multiple mounting features configured to engage one or more corresponding mounting features of the respective coupler. For example, each receptacle of the tubing hanger and/or each receptacle of the THRT may include a first mounting feature and a second mounting feature, a first coupler (e.g., electrical coupler) may include a first corresponding mounting feature configured to engage the first mounting feature of the receptacle, and a second coupler (e.g., hydraulic coupler) may include a second corresponding mounting feature configured to engage the second mounting feature of the receptacle. In addition, the mounting features 86 of the tubing hanger 28 may be the same or different than the mounting features 86 of the THRT 30.

In certain embodiments, at least one coupler may be coupled to the respective body by a respective adapter. For example, a coupler may be configured to interface with a different receptacle configuration/mounting feature configuration. An adapter configured to engage the coupler and the respective receptacle/mounting feature(s) of the tubing hanger or the THRT may be coupled to the coupler. The adapter may then be engaged with the respective receptacle/mounting feature(s). Accordingly, the tubing hanger and/or the THRT may receive couplers configured to interface with different receptacle/mounting feature configurations.

Certain couplers may be selected to facilitate flow of desired fluids and/or desired signals through the tubing hanger/THRT interface. For example, one or more hydraulic couplers may be disposed within the receptacle(s) 52 of the tubing hanger 28, one or more chemical injection couplers may be disposed within the receptacle(s) 52 of the tubing hanger 28, one or more electrical couplers may be disposed within the receptacle(s) 52 of the tubing hanger 28, one or more fiber optic couplers may be disposed within the receptacle(s) 52 of the tubing hanger 28, one or more other suitable couplers may be disposed within the receptacle(s) 52 of the tubing hanger 28, or a combination thereof. Corresponding couplers may be disposed within the receptacles 64 of the THRT 30 to establish the desired connections across the tubing hanger/THRT interface.

As previously discussed, an electrical coupler 56 is disposed within the first receptacle 58 of the tubing hanger 28, and an electrical coupler 68 is disposed within the first receptacle 70 of the THRT 30. The electrical couplers are configured to engage one another while the tubing hanger 28 is coupled to the THRT 30, thereby establishing electrical connection(s) across the tubing hanger/THRT interface. One or more electrical conductors may extend along the respective passage 50 to the electrical coupler 68 of the THRT 30, and one or more electrical conductors may extend along a respective passage 92 to the electrical coupler 56 of the tubing hanger 28. The electrical couplers are configured to establish electrical connection(s) between the electrical conductors.

Furthermore, a hydraulic coupler 60 is disposed within the second receptacle 62 of the tubing hanger 28, and a hydraulic coupler 72 is disposed within the second receptacle 74 of the THRT 30. The hydraulic couplers are configured to engage one another while the tubing hanger 28 is coupled to the THRT 30, thereby establishing a hydraulic connection across the tubing hanger/THRT interface. Hydraulic fluid may flow through the respective passage 50 to the hydraulic coupler 72 of the THRT 30, and hydraulic fluid may flow from the hydraulic coupler 60 of the tubing hanger 28 to the respective passage 92. The hydraulic couplers are configured to establish a hydraulic connection between the passages while the hydraulic couplers are coupled to one another. In addition, the hydraulic couplers are configured to block flow of hydraulic fluid from/to the respective passages while the hydraulic couplers are disengaged from one another. While the tubing hanger and the THRT include hydraulic and electrical couplers in the illustrated embodiment, in other embodiments, the tubing hanger and the THRT may include other suitable type(s) of coupler (e.g., alone or in combination with at least one of the hydraulic couplers or the electrical couplers), such as fiber optic couplers, chemical injection couplers, other suitable type(s) or couplers, or a combination thereof.

In the illustrated embodiment, a tapered section 94 is formed between each receptacle 64 of the THRT 30 and the respective passage 50. In addition, a tapered section 96 is formed between each receptacle 52 of the tubing hanger 28 and the respective passage 92. While a tapered section is formed between each receptacle and the respective passage in the illustrated embodiment, in other embodiments, the tapered sections of the THRT and/or the tapered sections of the tubing hanger may be omitted.

Figure 4:
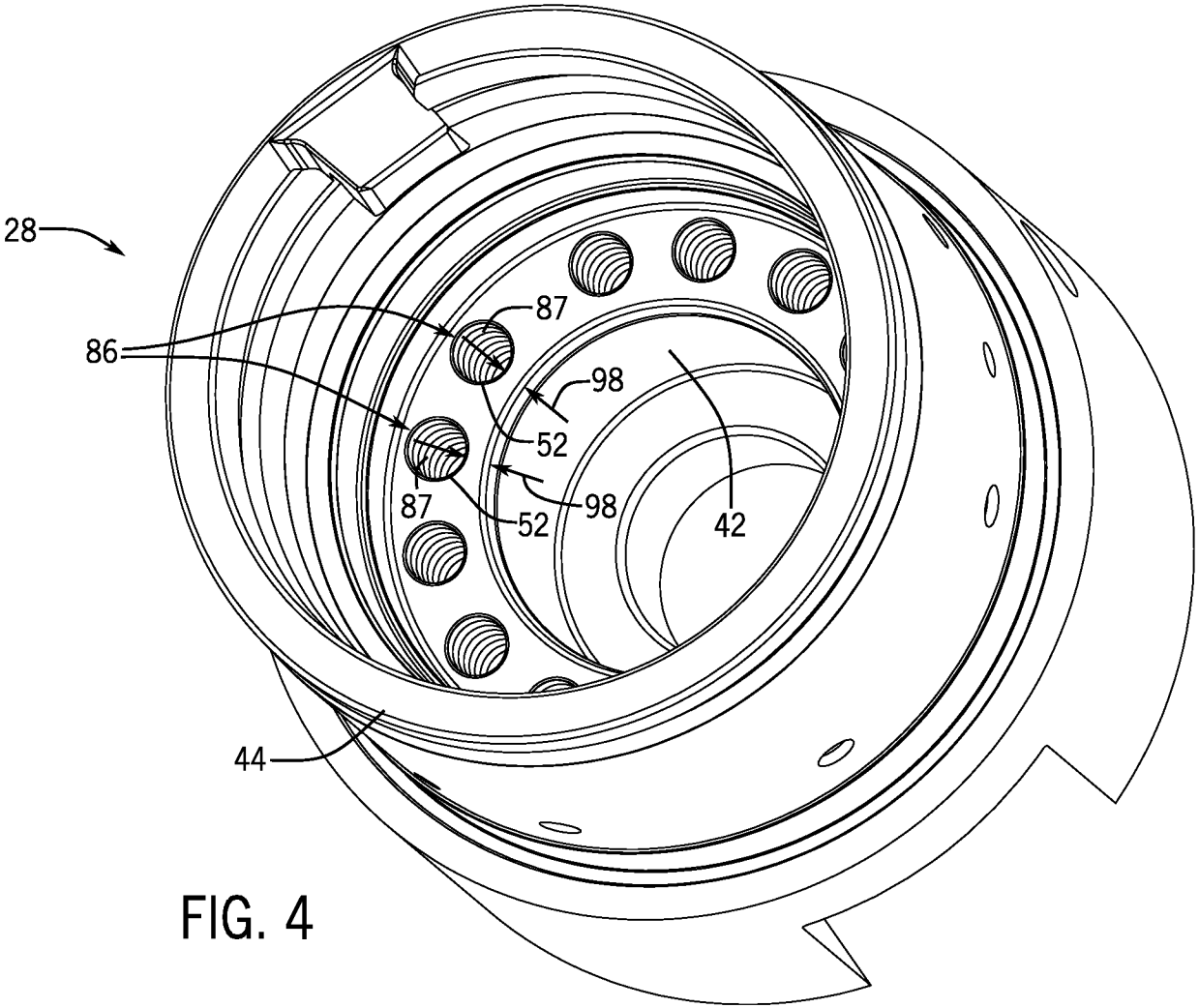
FIG. 4 is a perspective view of the tubing hanger of FIG. 2.

FIG. 4 is a perspective view of the tubing hanger 28 of FIG. 2. As illustrated, the body 44 of the tubing hanger 28 has multiple receptacles 52 positioned radially outward from the central bore 42. In the illustrated embodiment, the distances 98 (e.g., radial distances) between the receptacles 52 and the central bore 42 are substantially equal to one another (e.g., within manufacturing tolerance of one another). However, in other embodiments, the distance (e.g., radial distance) between at least one receptacle and the central bore may be different than the distance (e.g., radial distance) between at least one other receptacle and the central bore. Furthermore, in the illustrated embodiment, each receptacle 52 of the tubing hanger 28 has a circular cross-section. However, in other embodiments, each receptacle may have any other suitable cross-sectional shape. In addition, in the illustrated embodiment, the tubing hanger 28 has twelve receptacles 52. However, in other embodiments, the tubing hanger may have more or fewer receptacles (e.g., 2, 3, 4, 5, 6, 7, 8, 9, 10, 11, 13, or more).

Figure 5:
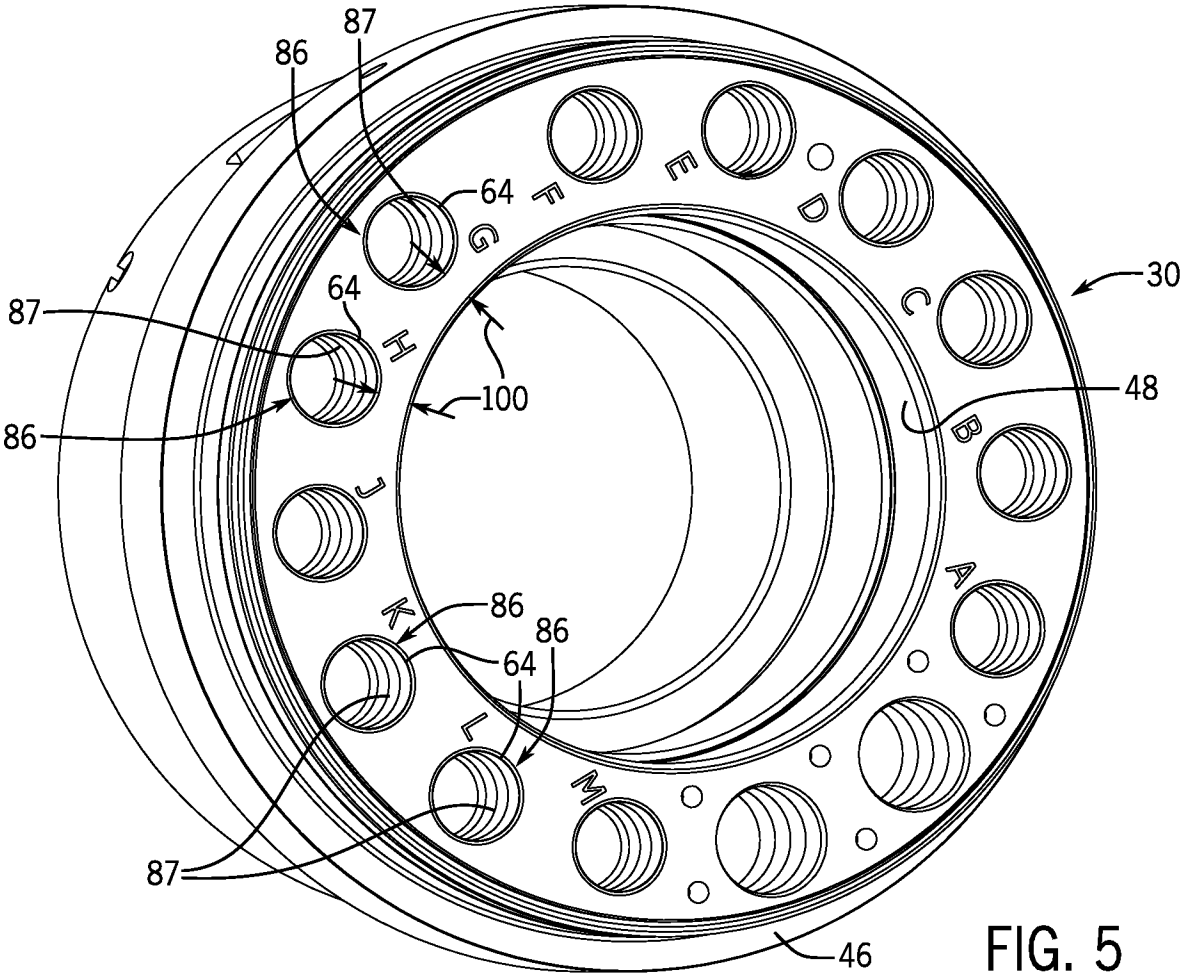
FIG. 5 is a perspective view of the tubing hanger running tool of FIG. 2.

FIG. 5 is a perspective view of the tubing hanger running tool (THRT) 30 of FIG. 2. As illustrated, the body 46 of the THRT 30 has multiple receptacles 64 positioned radially outward from the central bore 48. In the illustrated embodiment, the distances 100 (e.g., radial distances) between the receptacles 64 and the central bore 48 are substantially equal to one another (e.g., within manufacturing tolerance of one another). However, in other embodiments, the distance (e.g., radial distance) between at least one receptacle and the central bore may be different than the distance (e.g., radial distance) between at least one other receptacle and the central bore. Furthermore, in the illustrated embodiment, each receptacle 64 of the THRT 30 has a circular cross-section. However, in other embodiments, each receptacle may have any other suitable cross-sectional shape. In addition, in the illustrated embodiment, the THRT 30 has twelve receptacles 64. However, in other embodiments, the THRT may have more or fewer receptacles (e.g., 2, 3, 4, 5, 6, 7, 8, 9, 10, 11, 13, or more). For example, the THRT may have the same number of receptacles as the tubing hanger.

Technical effects of the disclosure include reducing the costs associated with extracting hydrocarbons. For example, a variety of types of couplers may be disposed within receptacles of a body to establish a configurable coupling assembly. Because the receptacles are substantially the same as one another and configured to receive couplers of different types, a variety of coupling assembly configurations may be established with a single body (e.g., single type of body). For example, a tubing hanger and a compatible THRT may be formed by selecting appropriate types of couplers for an application, disposing the couplers in the respective receptacles of the tubing hanger and the THRT, and coupling the THRT to the tubing hanger. As a result, the process of particularly designing and manufacturing a tubing hanger and a THRT for a particular application may be obviated, thereby substantially reducing the costs associated with extraction of hydrocarbons.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A configurable tubing hanger, comprising:

a body having a central bore and a plurality of receptacles, wherein the central bore is configured to facilitate flow of hydrocarbons through the body, the body is configured to secure a tubing within a well-bore, the plurality of receptacles are positioned radially outward from the central bore, the plurality of receptacles are substantially the same as one another, the plurality of receptacles is configured to receive a respective plurality of couplers, and the respective plurality of couplers comprises a plurality of different types of couplers;

wherein each receptacle of the plurality of receptacles comprises respective threads configured to couple a respective coupler of the plurality of couplers to the body;

wherein a first keyway is formed across threads of at least one receptacle of the plurality of receptacles and a second keyway is formed across corresponding threads of at least one respective coupler of the plurality of couplers;

wherein rotation of the at least one respective coupler relative the body is blocked when a key is disposed in the first and second keyways.

2. The configurable tubing hanger of claim 1, comprising the respective plurality of couplers.

3. The configurable tubing hanger of claim 2, wherein the plurality of different types of couplers comprises two or more of a fiber optic coupler, an electrical coupler, a hydraulic coupler, or a chemical coupler.

4. The configurable tubing hanger of claim 1, wherein at least one coupler of the plurality of couplers is further configured to engage another coupler and the another coupler is disposed within another receptacle.

* * * * *